US012723477B1

(12) United States Patent
Wan et al.

(10) Patent No.: US 12,723,477 B1
(45) Date of Patent: Sep. 1, 2026

(54) FORWARD AND REVERSE CIRCULATION ASSEMBLY FOR CORE DRILLING TOOLS AND CORING OPERATION METHOD UTILIZING THE SAME

(71) Applicant: Hunan University of Science and Technology, Xiangtan (CN)

(72) Inventors: Buyan Wan, Xiangtan (CN); Yongping Jin, Xiangtan (CN); Xiangyang Dong, Xiangtan (CN); Jialiang Wang, Xiangtan (CN)

(73) Assignee: Hunan University of Science and Technology, Xiangtan (CN)

( * ) Notice: Subject to any disclaimer, the term of this patent is extended or adjusted under 35 U.S.C. 154(b) by 0 days.

(21) Appl. No.: 19/446,042

(22) Filed: Jan. 12, 2026

(30) Foreign Application Priority Data

Jul. 11, 2025 (CN) ..... 202510953771.0

(51) Int. Cl.
*E21B 21/00* (2006.01)
*E21B 25/00* (2006.01)

(52) U.S. Cl.
CPC ..... *E21B 21/00* (2013.01); *E21B 25/00* (2013.01)

(58) Field of Classification Search
CPC ..... E21B 25/00; E21B 21/00
See application file for complete search history.

(56) References Cited

U.S. PATENT DOCUMENTS 1,907,155 A * 5/1933 Murdock ..... E21B 25/00 175/324
2012/0261192 A1 10/2012 Claude

FOREIGN PATENT DOCUMENTS

| | | | |
|---|---|---|---|
| CN | 105715221 | A | 6/2016 |
| CN | 108301802 | B | 7/2018 |
| CN | 215369766 | U | 12/2021 |
| CN | 218759795 | U | 3/2023 |
| CN | 116556866 | A | 8/2023 |

(Continued)

OTHER PUBLICATIONS

Lin Ii, etc. "Differential Pressure Bore Bottom Loca lity ReverseC ircu lation Tool DesignLIN" Tnon-Ferrousm in Ing Andm etallurgy, Issue 03,Jun. 15, 2010,pp. 16-19.

(Continued)

*Primary Examiner* — Giovanna Wright
(74) *Attorney, Agent, or Firm* — Birchwood IP

(57) ABSTRACT

Provided are a forward and reverse circulation assembly for core drilling tools and a coring operation method using the same. The forward and reverse circulation assembly includes an outer tube body and an inner receiving body arranged inside it, defining a downward drilling fluid channel between the two, at least one longitudinal fluid acceleration groove is formed on an outer peripheral wall of the inner receiving body. During operation, the drilling fluid is rapidly accelerated as it flows through the acceleration groove, thereby forming a stable negative pressure zone downstream. The negative pressure zone is formed by a reverse circulation channel, which draws fluid and rock cores upwards from a rock core inlet, thereby creating a protective local reverse circulation. A mainstream drilling fluid that does not participate in a reverse circulation continues to flow downwards, thereby forming a forward circulation for chip removal and cooling.

7 Claims, 10 Drawing Sheets

(56) References Cited

FOREIGN PATENT DOCUMENTS

| | | | |
|---|---|---|---|
| CN | 117969802 | A | 5/2024 |
| SU | 01511371 | A1 | 9/1989 |

OTHER PUBLICATIONS

Chen Zongtao, etc. "Research on key components of pump-suction coring drill with local reverse circulation" Coal Science and Technology, Issue12,Nov. 15, 2018,pp. 119-125.
Su Hong-an, etc, "Development of the Advanced Lateral Jet Wireine Coring Tool" Geology and Exploration, Issue 01,Jan. 15, 2014, pp. 178-181.

* cited by examiner

A-A

FORWARD AND REVERSE CIRCULATION ASSEMBLY FOR CORE DRILLING TOOLS AND CORING OPERATION METHOD UTILIZING THE SAME

CROSS-REFERENCE TO RELATED APPLICATIONS

This application claims priority to Chinese Patent Application No. 202510953771.0, filed on Jul. 11, 2025, which is hereby incorporated by reference in its entirety.

TECHNICAL FIELD

The present disclosure relates to the field of subsea drilling equipment technologies, and in particular, to a forward and reverse circulation assembly for core drilling tools and a coring operation method utilizing the same.

BACKGROUND

Submarine geological exploration is a foundation of deep-sea resource development and marine scientific research, and one of its core tasks is to obtain rock samples that can truly reflect in-situ information of the strata through drilling and coring operations. On the vast seabed, there is a special type of engineering geology widely distributed-loose and fragile strata. Typical representatives of such strata include but are not limited to: polymetallic sulfide deposits formed by hydrothermal activity, biogenic clastic sedimentary layers rich in organic matter, as well as altered basalt and turbidite rocks. The common geological characteristics of these strata are extremely low degree of cementation between rock and soil particles, highly developed pores, poor overall structural stability, and susceptibility to breakage and collapse when disturbed by external factors.

The existing seabed coring technologies, such as conventional rope coring and rotary drilling, mainly rely on mechanical thrust to "push" or "top in" the core into the rock core tube when facing the loose and fragile formations mentioned above. When the mechanical force mentioned above acts on loose rock cores that are already almost discrete, it is easy to cause structural fracture and severe disturbance of the rock core before it enters the rock core tube.

Besides that, the necessary forward circulation drilling fluid for conventional drilling is mainly used for chip removal and cooling of the drill bit. High pressure drilling fluid is sprayed out at high speed from the bottom of the drill bit, directly and violently flushing the hole bottom and fragile core samples that are about to enter the core tube. This hydraulic erosion process can wash away fine particles in loose rock cores, destroy their original bedding and structure, and even completely scatter the rock core, resulting in extremely low final recovery rates for coring operations, sometimes even below 10%. The samples obtained also lose most of their scientific research value due to severe disturbance.

SUMMARY

The purpose of the present disclosure is to provide a forward and reverse circulation assembly for core drilling tools and a coring operation method using the same, aiming to solve the problems of severe rock core fragmentation and extremely low coring recovery rate caused by hydraulic erosion and tube entry resistance in conventional coring drilling tools due to their single forward circulation mode and mechanical pushing coring method when facing loose and fragile formations in the prior art.

The present disclosure is implemented by the following technical solution.

A forward and reverse circulation assembly for core drilling tools, including:

an outer tube body;

an inner receiving body, configured to accommodate rock cores, provided inside the outer tube body, and a drilling fluid channel is provided between the inner receiving body and the outer tube body;

at least one longitudinal fluid acceleration groove is provided on an outer peripheral wall of the inner receiving body, and the longitudinal fluid acceleration groove is configured to form a negative pressure zone by increasing a local flow velocity when a drilling fluid flows through;

a reverse circulation channel, which communicates a lower rock core inlet of the inner receiving body with the negative pressure zone, and is configured to use a suction effect generated by the negative pressure zone to extract some drilling fluid and rock cores upwards from the rock core inlet, thereby forming a local reverse circulation;

where a mainstream drilling fluid that has not formed the local reverse circulation continues to flow along the drilling fluid channel to form a forward circulation.

In some embodiments of the present disclosure, where the inner receiving body includes a recycling tube, a docking part is provided at a lower end of the recycling tube; the docking part is sleeved with a core taking tube, the fluid acceleration groove is provided on an outer peripheral wall of the docking part.

In some embodiments of the present disclosure, where the forward and reverse circulation assembly further includes an annular sealing member that is arranged around the docking part and adjacent to the fluid acceleration groove.

In some embodiments of the present disclosure, where the annular sealing member divides the drilling fluid channel into a first channel located above the annular sealing member and a second channel located below the annular sealing member; a water inlet groove is provided at an upper edge of the docking part, and the fluid acceleration groove is connected below the water inlet groove; the water inlet groove and the fluid acceleration groove jointly communicate the first channel and the second channel.

In some embodiments of the present disclosure, the reverse circulation channel includes a return channel arranged along an axis at an upper end of the core taking tube, and a bottom of the return channel is communicated to a collection chamber configured to accommodate the rock cores; an upper part of the core taking tube that is sleeved with the docking part is provided with an annular groove along an outer circumference, and the annular groove is provided with a drainage port that is communicated to the return channel; a lower side wall of the docking part is provided with a negative pressure channel corresponding to the drainage port, and the negative pressure channel is connected to the negative pressure zone at an opening on one side of an inner wall of the outer tube body.

In some embodiments of the present disclosure, a diameter of the negative pressure channel is smaller than a diameter of the drainage port.

In some embodiments of the present disclosure, the negative pressure channel is arranged to be inclined downward relative to the inner wall of the outer tube body.

In some embodiments of the present disclosure, a one-way valve is provided in the return channel.

In some embodiments of the present disclosure, the fluid acceleration groove is asymmetrically arranged along a circumferential direction of the docking part.

A coring operation method using the forward and reverse circulation assembly for core drilling tools as described above, including the following steps:

S1. system deployment and fluid supply, placing the forward and reverse circulation assembly including the outer tube body and the inner receiving body in a hole, and pumping a drilling fluid into the drilling fluid channel provided between the outer tube body and the inner receiving body through a high-pressure pump assembly;

S2. diversion and negative pressure generation, using the annular sealing member provided inside the drilling fluid channel and surrounding the inner receiving body to divide the drilling fluid channel into an upper first channel and a lower second channel; and using the drilling fluid in the first channel as a only flow path, causing it to flow through the at least one fluid acceleration groove provided on the outer peripheral wall of the inner receiving body, thereby forming a negative pressure zone in the second channel;

S3. collaborative operation of forward and reverse circulation, utilizing the negative pressure zone to extract fluid and rock cores from the rock core inlet of the inner receiving body through the reverse circulation channel, thereby forming the local reverse circulation to guide and protect the rock cores; and a mainstream drilling fluid flowing through the fluid acceleration groove being led out from a bottom of the forward and reverse circulation assembly, thereby forming a forward circulation for chip removal, cooling, and wall protection.

Compared with the existing technology, the present disclosure has the following advantages.

1. The present disclosure utilizes fluid dynamics principles to automatically generate a stable negative pressure zone by ingeniously providing the fluid acceleration groove on the outer wall of the inner receiving body. The local reverse circulation driven by the negative pressure zone can generate a gentle and sustained suction force, which can "suck" loose and fragile rock cores into the inner receiving body, rather than the traditional single "pushing" or "topping in" method. This "pressure differential guidance" core extraction method greatly reduces the damage of mechanical stress to the rock core, minimizes the disturbance of the rock core, and can greatly improve the core recovery rate of loose and fragile formations, and maximizing the preservation of the original bedding and structural integrity of the rock cores.
2. The present disclosure constructs a sophisticated forward and negative dual cycle collaborative working system. The local reverse circulation of the rock cores is specifically responsible for core protection sampling. The mainstream drilling fluid continues to perform the conventional forward circulation, thereby completing essential engineering tasks such as chip removal, cooling a drill bit, and stabilizing a borehole wall. Which effectively solves the inherent contradiction in conventional single circulation systems, where high-intensity debris removal fluids inevitably cause severe erosion of fragile rock cores, thereby achieving the parallel development of high-quality core extraction and high-efficiency drilling.
3. The negative pressure generation and reverse circulation drive of the present disclosure rely on the fluid energy of the drilling fluid itself, and achieve energy conversion through a fixed, non-moving component, that is the fluid acceleration groove, which belongs to passive self-drive. This design does not require any additional power sources underground, such as micro motors, turbines, or mechanical pumps, thus avoiding the inherent reliability issues of these complex moving parts in deep-sea high-pressure, highly corrosive, and strong vibration environments.

BRIEF DESCRIPTION OF DRAWINGS

In order to provide a clearer explanation of the technical solution in the embodiments of the present disclosure, a brief introduction will be given to the accompanying drawings required for the description of the embodiments.

DESCRIPTION OF EMBODIMENTS

In order to clarify the purpose, technical solution, and advantages of the present disclosure, the specific embodiments of the present disclosure will be described in detail below in combination with the accompanying drawings. It should be noted that the embodiments described in this specification are only a partial preferred embodiment of the present disclosure, and not all embodiments. Based on this embodiment, all other embodiments obtained by those skilled in the art without creative work are within a protection scope of the present disclosure.

Embodiment 1: this embodiment provides a forward and reverse circulation assembly for coring operations in loose and fragile formations on the seabed. The forward and reverse circulation assembly serves as a core module of a coring tool and works in combination with other conventional components of the coring tool.

Figure 1:
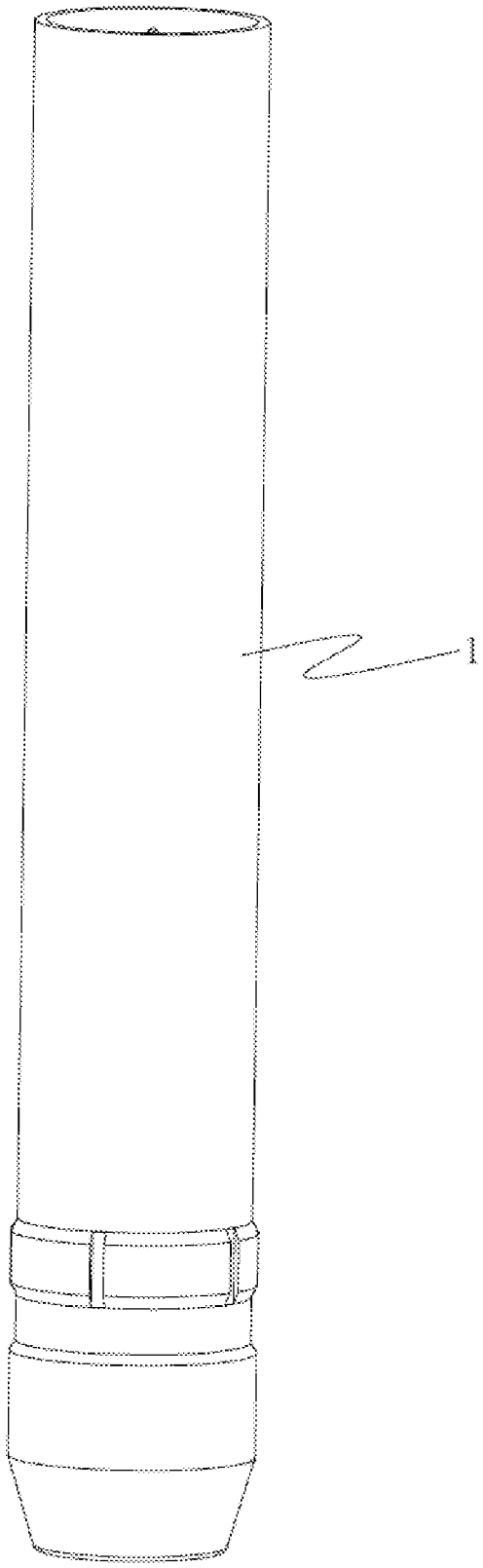
FIG. 1 is a schematic diagram of a three-dimensional structure of an embodiment.
Figure 2:
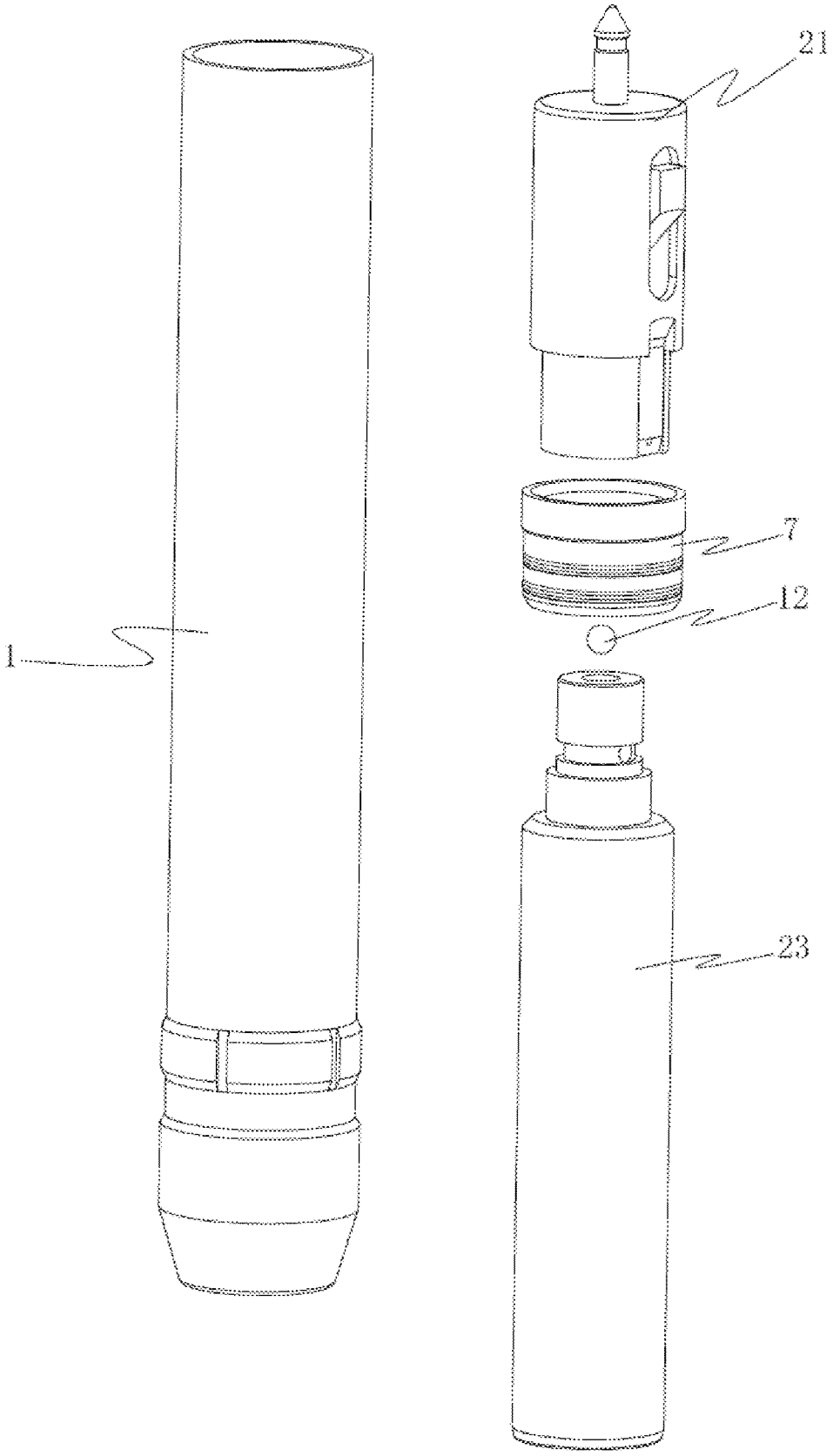
FIG. 2 is a schematic diagram of a decomposition structure of an embodiment.
Figure 3:
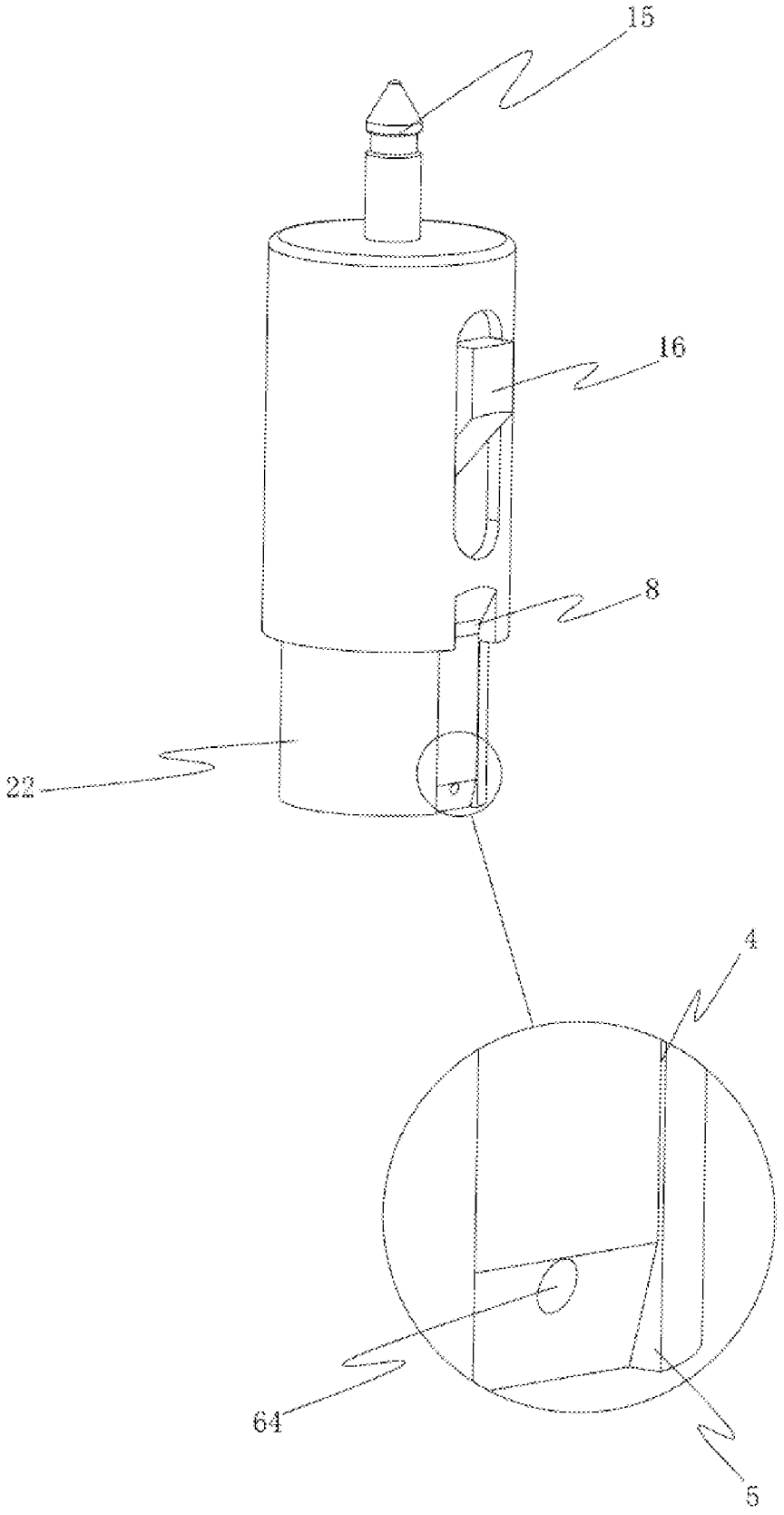
FIG. 3 is a schematic diagram of a three-dimensional structure of a recycling tube in an embodiment.
Figure 4:
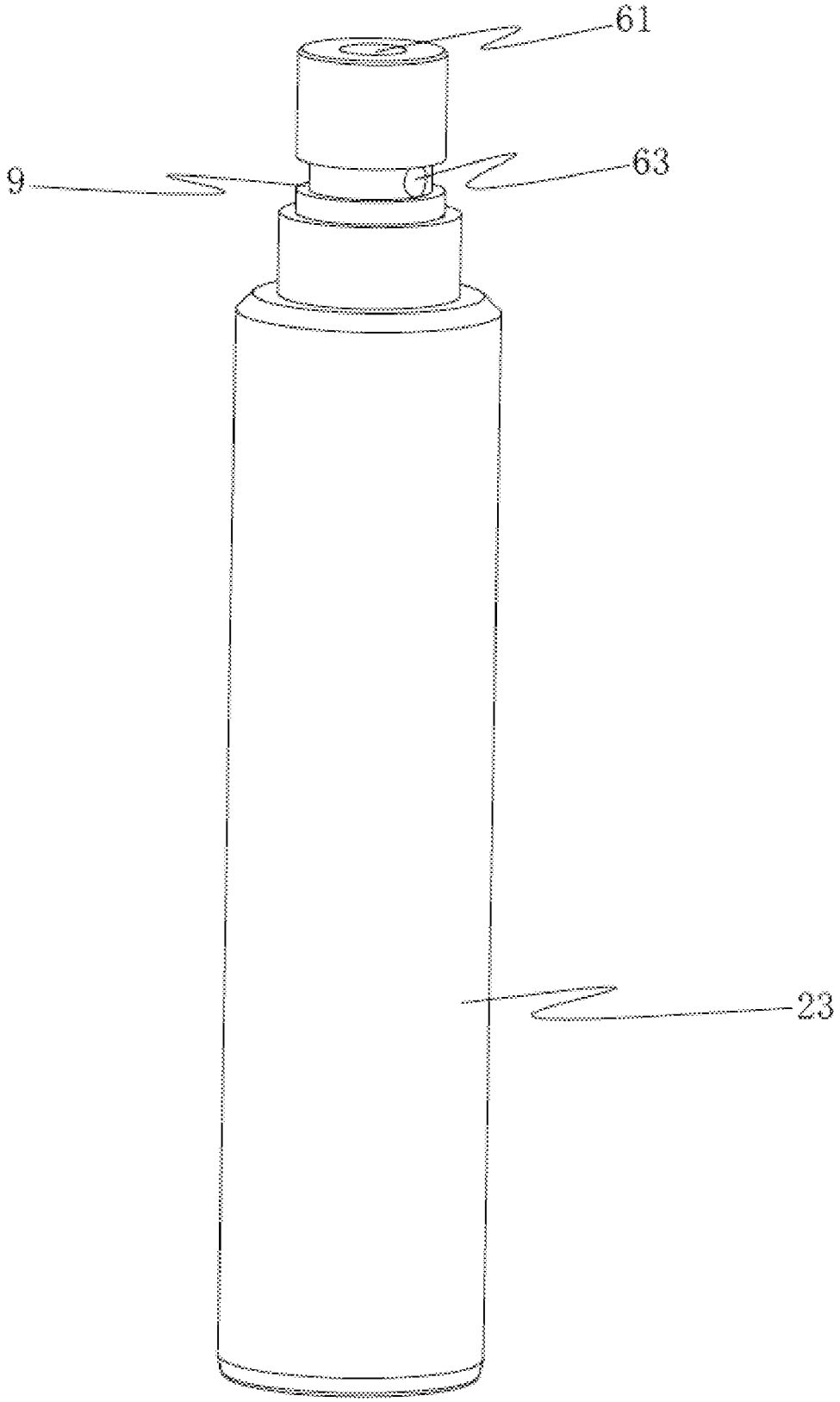
FIG. 4 is a schematic diagram of a three-dimensional structure of a core taking tube in an embodiment.
Figure 5:
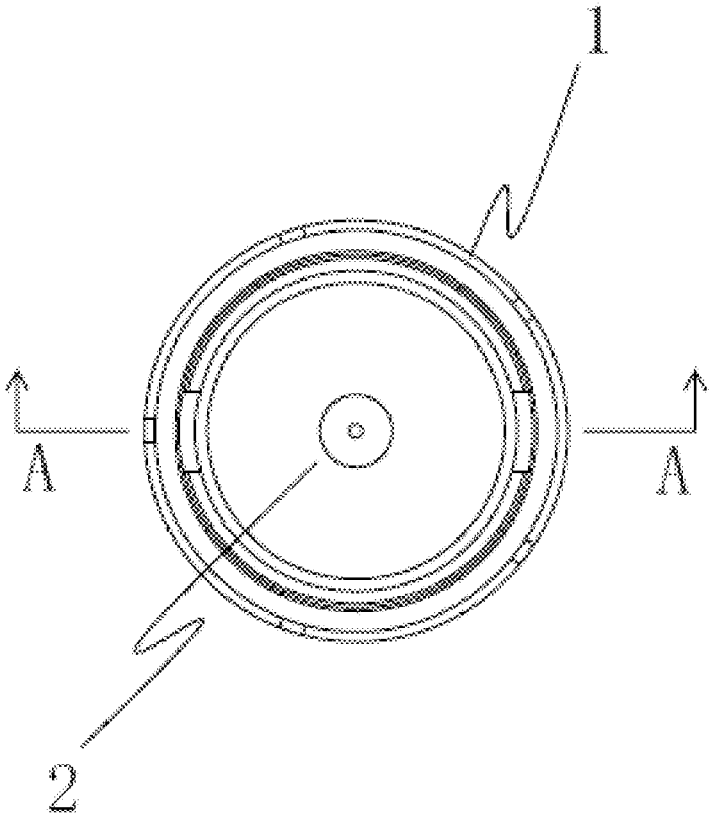
FIG. 5 is a top view of an embodiment.
Figure 6:
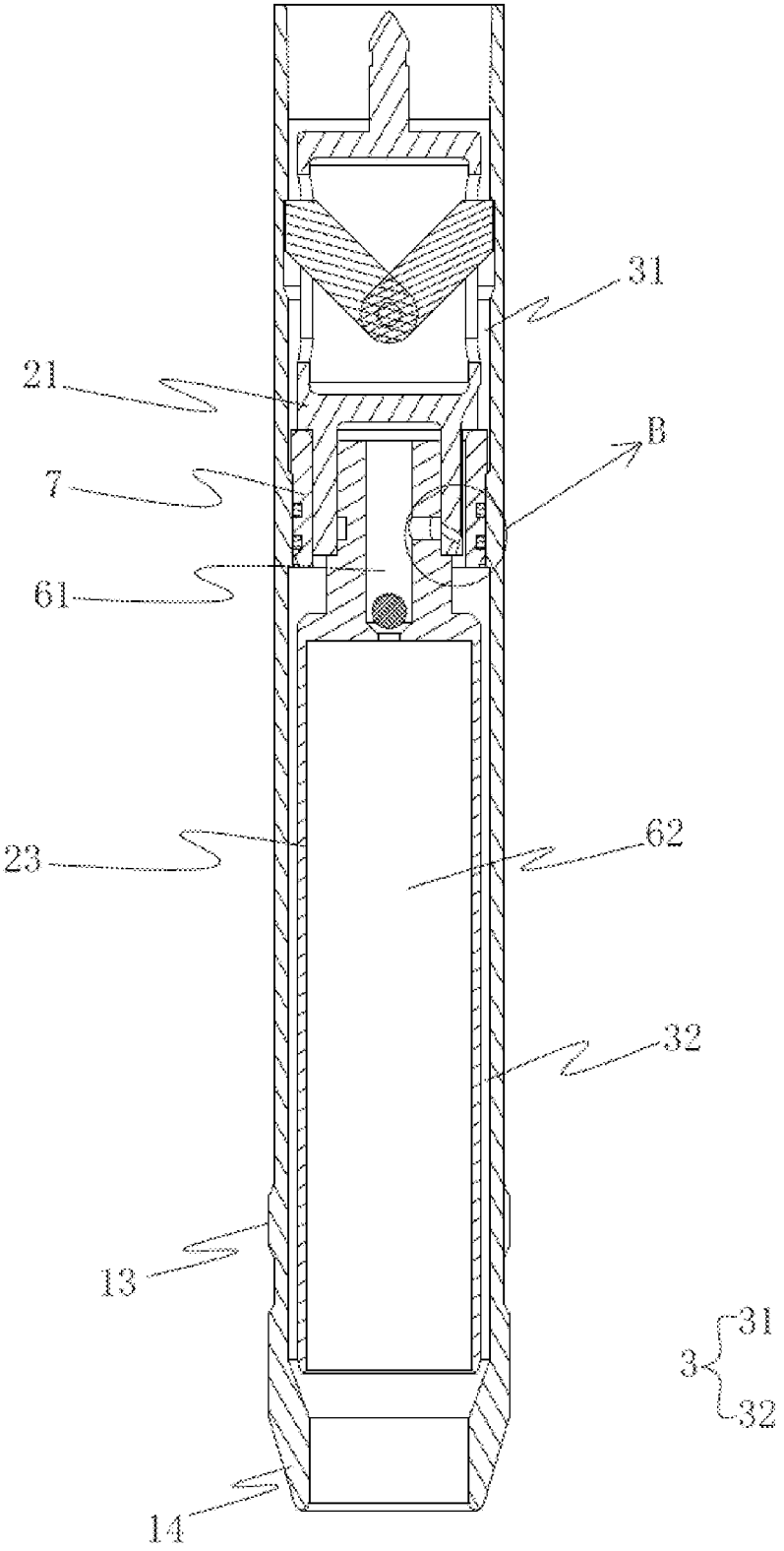
FIG. 6 is a cross-sectional view taken along line A-A in FIG. 5.
Figure 7:
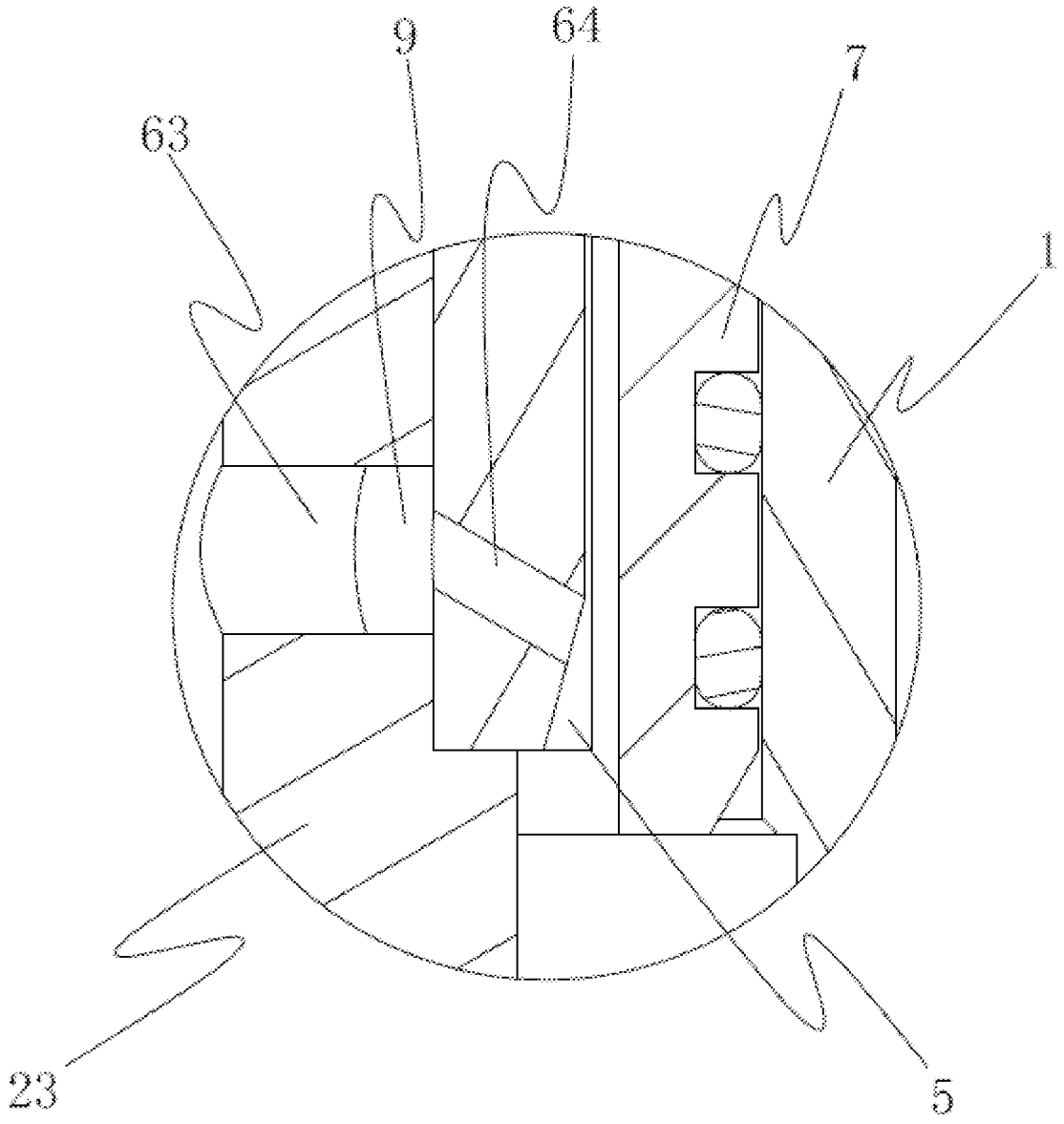
FIG. 7 is an enlarged schematic diagram of point B in FIG. 6.
Figure 8:
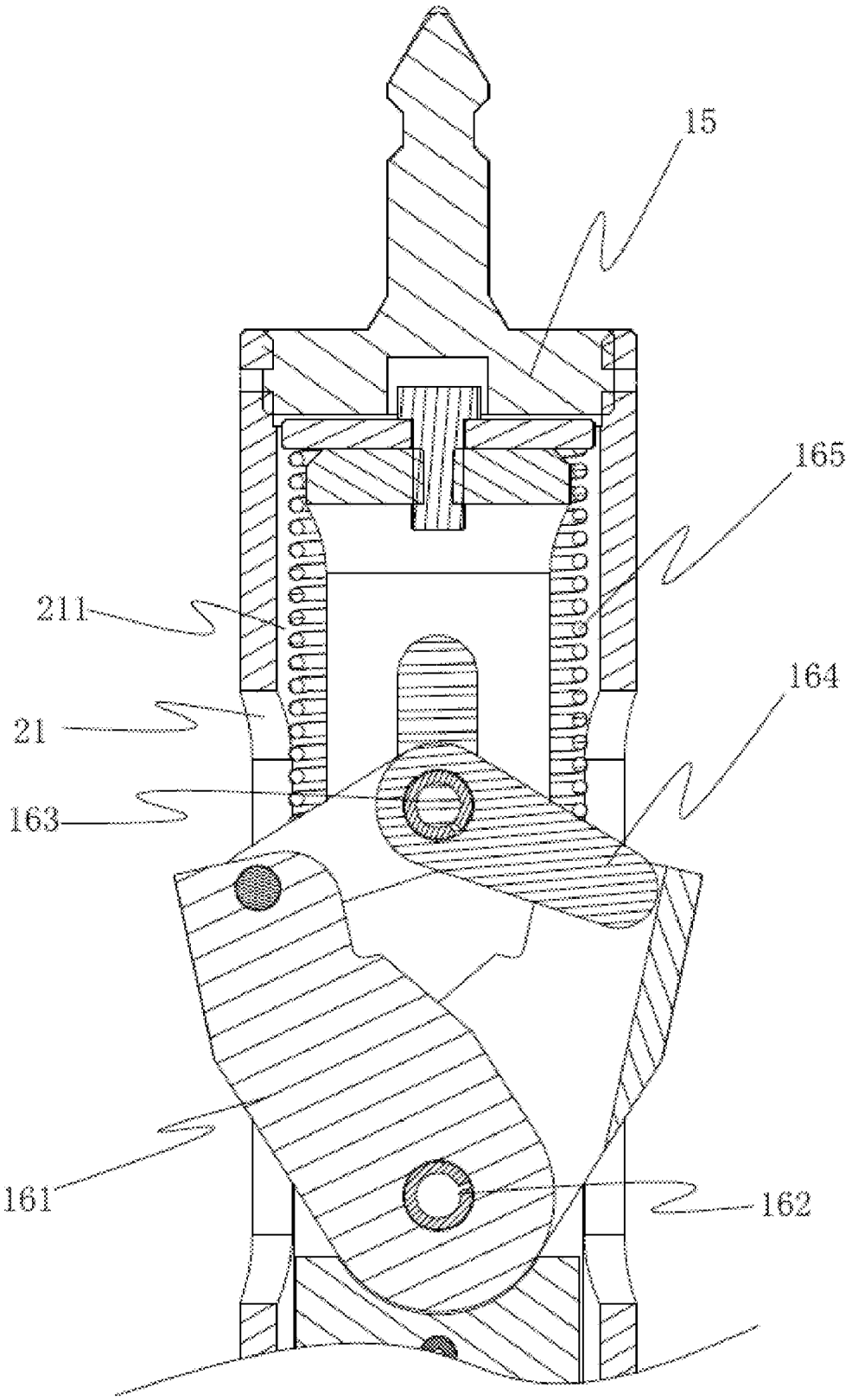
FIG. 8 is a schematic diagram of a possible structure of a locking and recycling mechanism in Embodiment 1.
Figure 9:
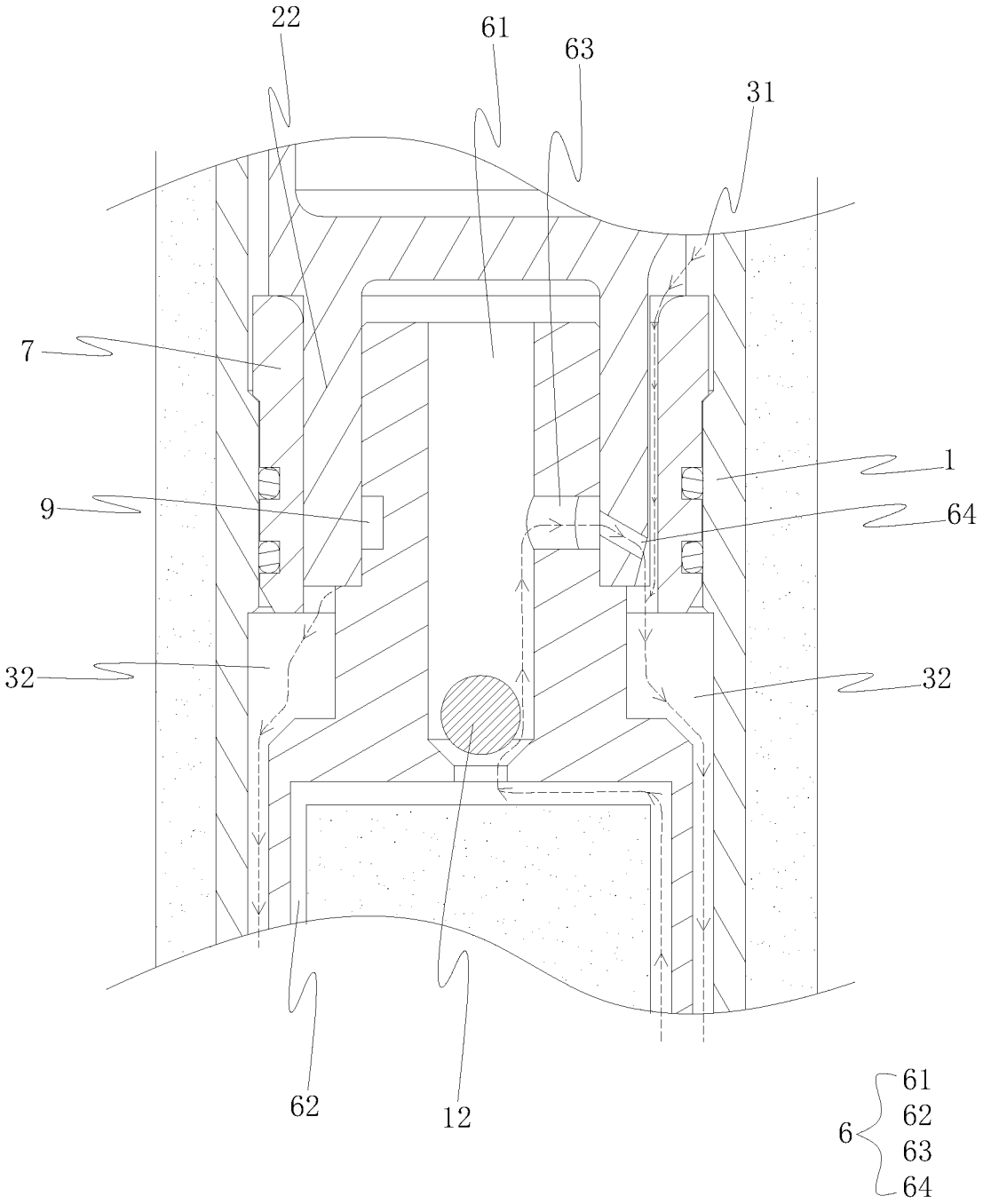
FIG. 9 is a first schematic diagram of a forward and reverse circulation route of a drilling fluid during underwater coring operation in an embodiment.
Figure 10:
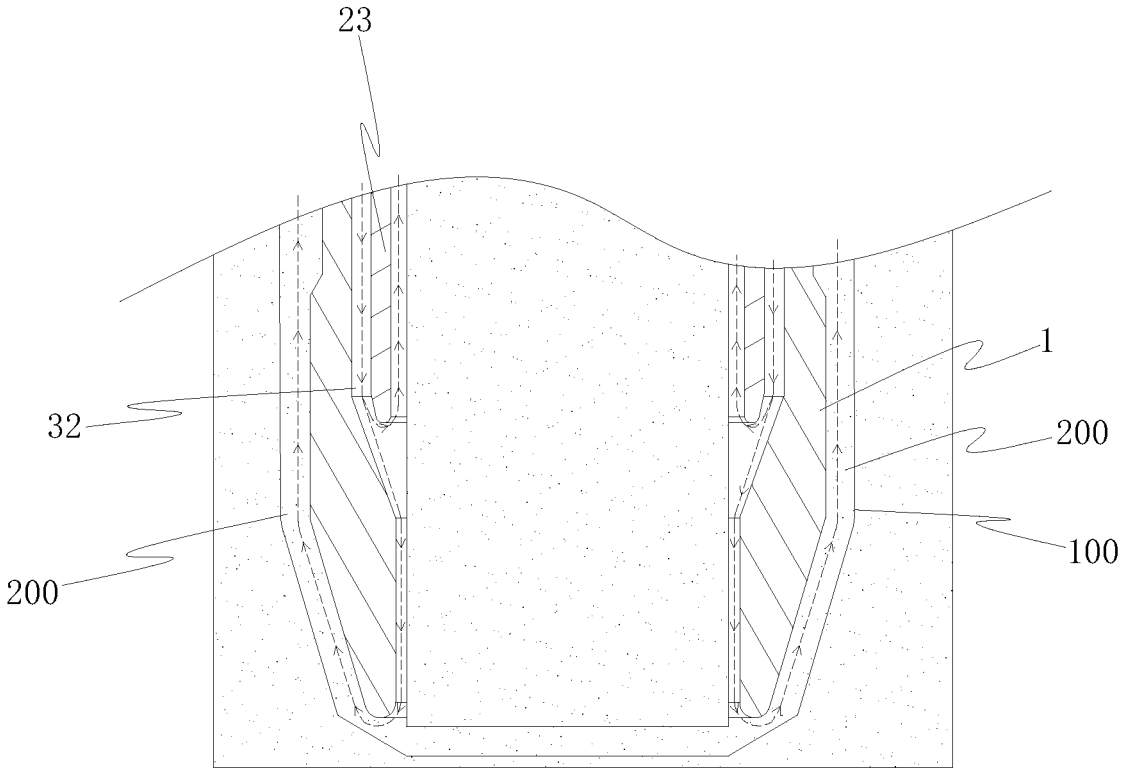
FIG. 10 is a second schematic diagram of the forward and reverse circulation route of the drilling fluid during underwater coring operation in an embodiment.

Please refer to FIGS. 1 to 10. In an implementation mode of the present disclosure, a forward and reverse circulation assembly for a core drilling tool is provided, which includes an outer tube body 1 and an inner receiving body 2. The inner receiving body 2 is configured to accommodate rock core samples obtained from the formation, and it is detachably installed in an internal area of the outer tube body 1. A circular downward drilling fluid channel 3 is naturally provided between an outer wall of the inner receiving body 2 and an inner wall of the outer tube body 1, thereby ensuring a smooth circulation of drilling fluid to maintain drilling stability.

At least one longitudinal fluid acceleration groove 4 is provided on an outer peripheral wall of the inner receiving body 2. This fluid acceleration groove 4 is a core feature of this embodiment, which achieves changes in fluid characteristics through structural changes. In an implementation mode, a local flow cross-sectional area of the fluid acceleration groove 4 is designed to be much smaller than a main flow cross-sectional area of the downward drilling fluid channel 3. This differentiated design of cross-sectional area is based on a continuity equation and Bernoulli's theorem in fluid mechanics. When drilling fluid is forcibly squeezed into this narrow fluid acceleration groove 4 from a wide main channel, its local flow velocity will experience a sharp and several fold increase. According to Bernoulli's principle, a sharp increase in flow velocity will lead to a significant decrease in fluid static pressure, thereby forming a stable negative pressure zone 5 in a downstream area of the fluid acceleration groove 4.

In order to utilize the negative pressure zone 5, the forward and reverse circulation assembly of this embodiment is further provided with a reverse circulation channel 6. As shown in FIGS. 3, 7, and 9 to 10, this channel cleverly communicates a vicinity of a rock core inlet at a lower part of the inner receiving body 2 with the negative pressure zone 5 mentioned above. When a strong low-pressure environment is formed in the negative pressure zone 5, a suction effect is applied to the rock core inlet through the reverse circulation channel 6. This suction force can not only greatly reduce the resistance of loose seabed rock cores entering the inner receiving body 2, but also actively suck the rock cores and a small amount of fluid around them into the inner receiving body 2, thereby forming a local reverse circulation from bottom to top. This gentle and guiding feedback loop is the key to ensuring the complete and undisturbed acquisition of loose and fragile rock cores. At the same time, please refer to FIGS. 8 to 9 for details. The mainstream drilling fluid that does not participate in the formation of local reverse circulation constitutes a main body of a forward circulation. It continues to flow downwards along the downward drilling fluid channel 3 and is ejected through an edge of a centering drill bit provided at a bottom of the outer tube body 1. The hydraulic impact effect generated by sprayed drilling fluid can effectively assist the drill bit in breaking rocks and cleaning its cutting end face. Subsequently, this fluid carrying energy sucks the rock debris produced by the drill bit cutting, and then returns upward along the annular gap 200 provided between the outer wall of the outer tube body 1 and the rock hole wall 100. During this return process, drilling fluid continuously transports rock debris from the bottom of the hole to the orifice and ultimately discharges it onto the seabed, thereby completing its core role as a forward circulation of debris removal. At the same time, the upward flowing fluid also continues to flow through the outer wall of the outer tube body 1, carrying away huge heat generated by friction through heat exchange, playing a key cooling role in the entire core drilling tool. Not only that, in loose and fragile formations, the stable liquid column filled in an annular space gap 200 can also provide effective support for the fragile hole wall through its static water pressure, thereby significantly improving the stability of drilling and providing necessary guarantees for a smooth progress of the entire coring operation.

In an implementation mode, in order to achieve modularity in structure and recyclability in operation, the inner receiving body 2 can be structurally divided into an upper recycling tube 21 and a lower core taking tube 23. A lower end of the recycling tube 21 is provided with a precision machined docking part 22, which is coupled to an upper end of the core taking tube 23 through threads, buckles, interference fit, sleeve connection or other conventional connection methods in the field. The fluid acceleration groove 4 is provided on an outer peripheral wall of the docking part 22, rendering it to be a core base of the entire negative pressure generation system.

In an implementation mode, in order to optimize fluid control and enhance negative pressure effects, this assembly further includes an annular sealing member 7. The annular sealing member 7 can be a combination of wear-resistant and corrosion-resistant sealing bearing or high-performance O-ring, which tightly surrounds an outer circumference of the docking part 22 and is adjacent to the fluid acceleration groove 4 in an axial position.

In an implementation mode, the annular sealing member 7 physically separates the drilling fluid channel 3 into a first channel 31 located above the drilling fluid channel 3 and a second channel 32 located below the drilling fluid channel 3, thereby creating a differentiated fluid environment. At an upper edge of the docking part 22, one or more water inlet grooves 8 are provided. The drilling fluid first enters the water inlet groove 8 through the first channel 31, and then directly connects to the fluid acceleration groove 4 below the water inlet groove 8. In this way, the water inlet groove 8 and the fluid acceleration groove 4 together form a only flow path communicating the first channel 31 and the second channel 32. This design forces all downward drilling fluid to pass through a narrow acceleration groove, thereby utilizing all fluid kinetic energy to generate negative pressure, thereby greatly enhancing the suction effect of the reverse circulation.

In an implementation mode, the reverse circulation channel 6 can be designed as follows: at the upper end of the core taking tube 23, a return channel 61 is provided along its central axis, and a bottom of the channel is directly connected to a collection chamber 62 that accommodates the rock cores. At an upper part of the core taking tube 23 where it is sleeved to the docking part 22, there is an annular groove 9 on its outer peripheral wall. A drainage port 63 is provided on the annular groove 9 and penetrates a wall of the core taking tube 23 to communicate with the return channel 61. At the same time, a negative pressure channel 64 corresponding to a position of the drainage port 63 is provided on a lower side wall of the docking part 22. After the inner tube assembly is assembled, the annular groove 9 becomes an intermediate fluid chamber, allowing the drainage port 63 to communicate with the negative pressure channel 64. Finally, an outlet of the negative pressure channel 64 faces towards the inner wall of the outer tube body 1 and is directly connected to the negative pressure zone 5. Thus, a reverse circulation channel 6 is formed from the collection chamber 62 of the rock cores to the negative pressure zone 5.

In an implementation mode, in order to optimize the fluid dynamics effect of the reverse circulation, an outlet diameter of the negative pressure channel 64 can be designed to be smaller than an inlet diameter of the drainage port 63, to form a jet effect and further stabilize a flow field. At the same time, the negative pressure channel 64 is inclined downwards relative to the inner wall of the outer tube body 1, with an inclination angle of 15-45 degrees, which helps to guide the reverse circulation fluid to flow more smoothly into the downward main flow.

In an implementation mode, in order to ensure the unidirectionality of the reverse circulation, a one-way valve 12 can be provided in the return channel 61. The one-way valve 12 can adopt a simple and reliable gravity ball valve structure, which is to set a valve seat in the return channel and place a high-density steel ball on the valve seat. Of course, other forms of valves such as spring valves, diaphragm valves, etc. can also be used.

In an implementation mode, the fluid acceleration groove 4 can be asymmetrically arranged along a circumference of the docking part 22, for example, only one or two are provided. This asymmetric design helps to form a more concentrated high-speed jet, thereby generating stronger negative pressure effects locally.

It should be emphasized that the forward and reverse circulation assembly proposed in this implementation for the core drilling tool is a core module of the core drilling tool, which works in combination with other conventional components of the core drilling tool. For example, in practical engineering applications, the forward and reverse circulation assembly proposed in this embodiment for core drilling tools can be combined with the following conventional components to perform deep-sea rope core extraction operations after core sample collection.

In an implementation mode, in order to match the efficient rope coring operation, an upper end of the recycling tube 21 can also be provided with a conventional locking and recycling mechanism in this field. This mechanism is used to ensure the absolute stability of the inner receiving body 2 during a drilling process, as well as the ability to be quickly and reliably recovered when needed. For example, referring to FIG. 8, the following structure can be specifically adopted.

Inside the recycling tube 21, there is a hollow accommodating chamber 211. The locking and recycling mechanism mainly includes a fishing head component 15 that can slide axially within the accommodating chamber 211 to a limited extent, and a snap plate linkage mechanism 16 for achieving locking. The snap plate linkage mechanism 16 may specifically include two spring clamp plates 161 located at a lower part of the accommodating chamber 211. A bottom of the two spring clamp plates 161 is hinged to a pin seat at a bottom of the accommodating chamber 211 through a pin shaft 162, and can swing inside and outside around a lower pivot point. An upper outer side of the spring clamp plates 161 is a locking surface, and the locking surface can extend outward through a predetermined through hole on a wall of the recycling tube 21, so as to be in contact with a pressure bearing step or annular groove on the inner wall of the outer tube body 1. At an upper part of the accommodating chamber 211, a transverse hinge shaft 163 is fixedly provided. There are two connecting plates 164 coaxially hinged on the hinge shaft 163. Lower ends of the two connecting plates 164 are respectively hinged to upper ends of the two spring clamp plates 161 through pins, thereby forming a set of linkage mechanisms. A compression spring 165 is provided between the fishing head component 15 and a fixed step pre-installed inside the accommodating chamber 211. The compression spring 165 is configured to continuously apply a preload force to the fishing head component 15, it is caused to have a downward movement trend.

When the inner receiving body 2 is lowered into, placed and seated on the pressure bearing step through a steel wire rope, a tension of the steel wire rope disappears, and the fishing head component 15 no longer bears an upward load. At this point, the energy accumulated by the compression spring 165 becomes a dominant force, instantly pushing the fishing head component 15 to slide downward in the accommodating chamber. This downward displacement pushes an upper end of the spring clamp plates 161 outward through the connecting plate 164, effectively extending its outer locking surface and locking it into the inner wall clamp groove of the outer tube body 1, thereby achieving stable mechanical locking. When retrieving, when a specialized salvager grabs and lifts the fishing head component 15 upwards, the strong upward lifting force first overcomes the reaction force of the compression spring 165 and forces the fishing head component 15 to slide upwards in the accommodating chamber. It is this forced upward displacement that pulls the upper end of the spring clamp plates 161 inward through the connecting plate 164, causing its locking surface to completely detach from a clamp groove of the outer tube body 1. Once unlocked, continue to lift the steel wire rope to smoothly retrieve the entire inner receiving body 2 to the sea surface.

In an implementation mode, the locking and recycling functions mentioned above can also be achieved through other structures. For example, in an implementation mode, the locking and recycling mechanism can be a magnetic locking mechanism, and the snap mechanism can be replaced with a magnetic locking ring composed of strong permanent magnets. A set of magnets with N poles facing outward is installed on an outer wall of the docking part 22 of the inner receiving body 2, and a set of magnets with S poles facing inward is installed at the corresponding position on the inner wall of the outer tube body 1. When the inner tube assembly is lowered into place, the two sets of magnets are precisely aligned, thereby generating strong magnetic attraction to achieve locking. When retrieving, the lifting mechanical force provided by the salvager needs to be large enough to overcome the magnetic attraction and achieve unlocking.

In an implementation mode, the locking and recycling mechanism may also be a bayonet locking mechanism. The snap mechanism can be replaced with a mechanical structure similar to a rifle bolt or a bulb bayonet. One to two radial pins are provided on the outer wall of the docking part 22, and corresponding "J"-shaped or "L"-shaped guide grooves are machined on the inner wall of the outer tube body 1. During the process of lowering the inner receiving body 2, the pin is inserted into a guide groove by a slight rotation of the steel wire rope, and the locking is completed when it falls into the bottom of the groove. When recycling, first lift up a small distance and then rotate in an opposite direction to make the pin detach from the guide groove.

In addition, in order to adapt to complex loose and hard alternating formations, the outer tube body 1 includes a reamer 13 provided at its lower part, and the reamer 13 is connected to a wedge-shaped centering drill bit 14. A main function of the reamer 13 is to appropriately increase a diameter of the borehole during the drilling process, thereby creating conditions for a smooth insertion of the core taking tube 23, and helping to improve a circulation effect of the drilling fluid. The centering drill bit 14 ensures the accuracy of the drilling direction and prevents drilling deviation. These conventional components of the coring drilling tool, combined with the one proposed in this embodiment together form a set of high-performance underwater coring drilling tools that can cope with extreme working conditions.

This embodiment achieves a synergistic mechanism of forward and reverse circulation through the carefully designed structural combination mentioned above. In drilling operations, the mainstream drilling fluid forms a forward circulation along the drilling fluid channel 3, responsible for the discharge of drilling cuttings and support of the hole wall. At the same time, the negative pressure zone 5 generated by the fluid acceleration groove 4 drives the reverse circulation channel 6 to form a local reverse circulation, specifically responsible for gentle suction and protective collection of loose rock cores.

The collaborative work of this dual circulation system significantly improves the coring rate of loose and fragile formations, reduces core fragmentation, and maintains the in-situ characteristics of the formation. The entire system does not require external power and relies entirely on the flow energy of drilling fluid to achieve automatic control. It has the advantages of simple structure, reliable operation, and easy maintenance, and is particularly suitable for harsh working environments such as underwater drilling.

Embodiment 2: this embodiment combines the forward and reverse circulation assembly for coring drilling tools described in Embodiment 1 above to provide a detailed explanation of a coring operation method suitable for loose and fragile seabed formations. Specifically, it includes the following steps:

S1. System Deployment and Fluid Supply before starting an underwater drilling operation, assembling the forward and reverse circulation assembly as a core module. The inner receiving body 2 is placed into the outer tube body 1 of the coring drilling tool through the fishing head component 15 at a top of its recycling tube 21, and is then dropped into the outer tube body 1 via a steel wire rope. When a lower end of the inner receiving body 2 is axially positioned with the pressure bearing step provided inside the outer tube body 1, its snap mechanism automatically engages with a locking groove on the inner wall of the outer tube body 1, thereby completing the deployment. At the same time, a high-pressure pump unit of a marine drilling rig system is connected to a drill string, thereby preparing to transport seawater-based drilling fluid.

S2. Drilling Fluid Flow and Negative Pressure Generation

Operation begins, and the drilling fluid flows from top to bottom into the annular downward drilling fluid channel 3 formed between the outer tube body 1 and the inner receiving body 2. Under guiding and sealing action of the annular sealing member 7, all drilling fluid is forcibly introduced into the fluid acceleration groove 4 provided on the outer peripheral wall of the docking part 22. Due to a sudden decrease in fluid cross-sectional area, the drilling fluid is rapidly accelerated here, and its static pressure energy is converted into kinetic energy on a large scale, thereby creating a stable and high-intensity negative pressure zone 5 in the downstream area of the fluid acceleration groove 4. The negative pressure zone 5 is connected to the return channel 61 of the core taking tube 23 through the negative pressure channel 64, thereby providing continuous pressure differential driving force for local reverse circulation.

S3. Forward and Negative Cycle and Collaborative Core Picking

When the drilling fluid flows to a bottom of the drilling tool, under an action of the negative pressure zone 5, it automatically forms a cooperative forward and negative dual circulation:

local reverse circulation path and function: under a suction effect of the negative pressure zone 5, a part of the drilling fluid carries loose rock cores and is collected from the collection chamber 62 at the bottom of the core taking tube 23, through the return channel 61 (with the one-way valve 12 provided up), drainage port 63, annular groove 9, and negative pressure channel 64, and is sucked into the negative pressure zone 5, where it merges with the main fluid. This bottom-up local reverse circulation replaces "mechanical pushing" with "pressure differential guidance", thereby significantly reducing the resistance of rock core entering the tube and ensuring the quality of rock core samples.

Forward circulation path and function: the mainstream drilling fluid that does not participate in reverse circulation continues to flow down the downward drilling fluid channel 3, and is ejected at high speed through the centering drill bit 14 to complete hydraulic impact on the bottom of the hole and drill bit cooling. Subsequently, the main fluid sucked up the rock debris and returned along the annular gap 200 formed between the outer wall of the outer tube body 1 and the rock hole wall 100. During this process, three major engineering tasks were completed: hydraulic debris removal, forced convection heat transfer cooling, and liquid column static pressure support for the rock hole wall 100. Finally, the debris was discharged at the seabed orifice.

S4. Adaptive Adjustment of Operation Process

During a drilling process, there is also a dynamic optimization step. During the drilling process, the drilling rig system monitors real-time parameters such as pump pressure and displacement of the drilling fluid circulation system. An operator can determine the degree of looseness and fragility of the current formation based on geological profile predictions, adjacent hole data, or real-time drilling parameters such as torque and drilling pressure feedback. Based on this judgment, an output power of the high-pressure pump assembly can be controlled by frequency conversion to adaptively adjust a displacement and circulation speed of the drilling fluid. Its adjustment strategy aims to achieve the best balance between ensuring the quality of core recovery and maintaining 100% stability of the rock borehole wall: when encountering extremely loose formations, reduce the displacement to reduce the reverse circulation suction and forward circulation scouring of the borehole wall. When entering a hard interlayer with good bonding, the displacement can be increased to enhance chip removal efficiency and drill bit cooling effect.

S5. Inner Tube Recycling and Circulation Operation

After completing each core retrieval cycle, pause a pumping of drilling fluid and lower a dedicated fishing device through a steel wire rope. After the salvager is docked with the fishing head component 15 at the top of the recycling tube 21, the steel wire rope is lifted to unlock the snap mechanism, and the inner receiving body 2 loaded with rock cores is fully recovered to the sea surface. After completing the core extraction and equipment preparation, the inner receiving body can be re-released to start A next core extraction cycle.

The above implementation modes are provided in combination with specific content, and it is not assumed that the specific implementation of this application is limited to these explanations. Any similarity to the method structure of the present application, or any technical deduction or substitution based on the concept of the present application, should be considered as within the protection scope of the present application.

What is claimed is:

1. A forward and reverse circulation assembly for core drilling tools, comprising:

an outer tube body;

an inner receiving body, configured to accommodate rock cores, provided inside the outer tube body, and a drilling fluid channel is provided between the inner receiving body and the outer tube body;

at least one longitudinal fluid acceleration groove is provided on an outer peripheral wall of the inner receiving body, and the at least one longitudinal fluid acceleration groove is configured to form a negative pressure zone by increasing a local flow velocity when a drilling fluid flows through;

a reverse circulation channel, which communicates a lower rock core inlet of the inner receiving body with the negative pressure zone, and is configured to use a suction effect generated by the negative pressure zone to extract some drilling fluid and rock cores upwards from the rock core inlet, thereby forming a local reverse circulation;

wherein a mainstream drilling fluid that has not formed the local reverse circulation continues to flow along the drilling fluid channel to form a forward circulation;

wherein the inner receiving body comprises a recycling tube, a docking part is provided at a lower end of the recycling tube; the docking part is sleeved with a core taking tube, the at least one longitudinal fluid acceleration groove is provided on an outer peripheral wall of the docking part;

wherein the forward and reverse circulation assembly further comprises an annular sealing member that is arranged around the docking part and adjacent to the at least one longitudinal fluid acceleration groove;

wherein the annular sealing member divides the drilling fluid channel into a first channel located above the annular sealing member and a second channel located below the annular sealing member; a water inlet groove is provided at an upper edge of the docking part, and the at least one longitudinal fluid acceleration groove is connected below the water inlet groove; the water inlet groove and the at least one longitudinal fluid acceleration groove jointly communicate the first channel and the second channel.

2. The forward and reverse circulation assembly for core drilling tools according to claim 1, wherein the reverse circulation channel comprises a return channel arranged along an axis at an upper end of the core taking tube, and a bottom of the return channel is communicated to a collection chamber configured to accommodate the rock cores;

an upper part of the core taking tube that is sleeved with the docking part is provided with an annular groove along an outer circumference, and the annular groove is provided with a drainage port that is communicated to the return channel;

a lower side wall of the docking part is provided with a negative pressure channel corresponding to the drainage port, and the negative pressure channel is connected to the negative pressure zone at an opening on one side of an inner wall of the outer tube body.

3. The forward and reverse circulation assembly for core drilling tools according to claim 2, wherein a diameter of the negative pressure channel is smaller than a diameter of the drainage port.

4. The forward and reverse circulation assembly for core drilling tools according to claim 2, wherein the negative pressure channel is arranged to be inclined downward relative to the inner wall of the outer tube body.

5. The forward and reverse circulation assembly for core drilling tools according to claim 2, wherein a one-way valve is provided in the return channel.

6. The forward and reverse circulation assembly for core drilling tools according to claim 2, wherein the at least one longitudinal fluid acceleration groove is asymmetrically arranged along a circumferential direction of the docking part.

7. A coring operation method using the forward and reverse circulation assembly for core drilling tools according to claim 6, comprising the following steps:

S1. system deployment and fluid supply, placing the forward and reverse circulation assembly comprising the outer tube body and the inner receiving body in a hole, and pumping a drilling fluid into the drilling fluid channel provided between the outer tube body and the inner receiving body through a high-pressure pump assembly;

S2. diversion and negative pressure generation, using the annular sealing member provided inside the drilling fluid channel and surrounding the inner receiving body to divide the drilling fluid channel into an upper first channel and a lower second channel; and using the drilling fluid in the first channel as a only flow path, causing the drilling fluid to flow through the at least one longitudinal fluid acceleration groove provided on the outer peripheral wall of the inner receiving body, thereby forming a negative pressure zone in the second channel;

S3. collaborative operation of forward and reverse circulation, utilizing the negative pressure zone to extract fluid and rock cores from the rock core inlet of the inner receiving body through the reverse circulation channel, thereby forming the local reverse circulation to guide and protect the rock cores; and a mainstream drilling fluid flowing through the at least one longitudinal fluid acceleration groove being led out from a bottom of the forward and reverse circulation assembly, thereby forming a forward circulation for chip removal, cooling, and wall protection.

* * * * *